US005731777A

United States Patent [19]

Reynolds

[11] Patent Number: 5,731,777

[45] Date of Patent: Mar. 24, 1998

[54] RADIO-FREQUENCY ABSORBING FIN BLANKET

[75] Inventor: Robert L. Reynolds, Los Angeles, Calif.

[73] Assignee: Hughes Electronics, Los Angeles, Calif.

[21] Appl. No.: 577,597

[22] Filed: Dec. 22, 1995

Related U.S. Application Data

[63] Continuation-in-part of Ser. No. 154,050, Nov. 18, 1993, abandoned.

[51] Int. Cl.[6] ..... H01Q 17/00

[52] U.S. Cl. ..... 342/4

[58] Field of Search ..... 342/1, 2, 3, 4, 342/5

[56] References Cited

U.S. PATENT DOCUMENTS

| | | | |
|---|---|---|---|
| 4,164,718 | 8/1979 | Iwasaki | 342/4 |
| 4,947,174 | 8/1990 | Lehman et al. | 342/3 |
| 5,208,599 | 5/1993 | Rudduck et al. | 342/3 |
| 5,325,094 | 6/1994 | Broderick et al. | 342/1 |
| 5,373,296 | 12/1994 | Ishino et al. | 342/4 |
| 5,394,150 | 2/1995 | Naito et al. | 342/4 |

*Primary Examiner*—Daniel T. Pihulic
*Attorney, Agent, or Firm*—Terje Gudmestad; Wanda K. Denson-Low

[57] ABSTRACT

A fin blanket for attenuating radio-frequency scattering, thereby protecting a surface such as a feed-horn or radiator panels of a spacecraft. The fin blanket includes a plurality of fins formed of a microwave absorbing film, each fin including at least one planar side positioned generally parallel to an electric field formed by the radio-frequency scattering.

20 Claims, 4 Drawing Sheets

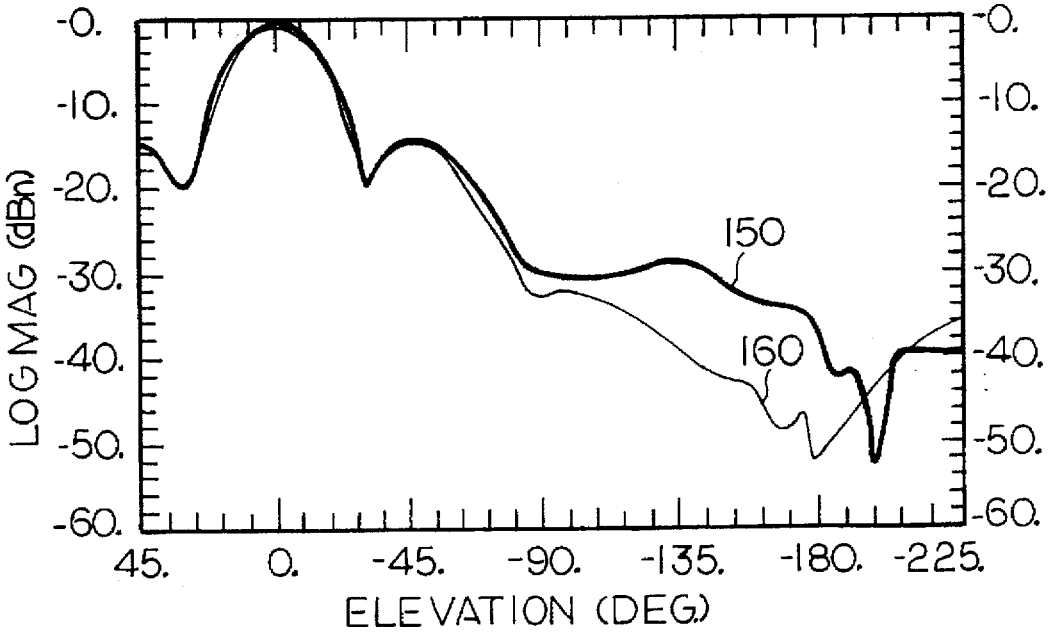
FIG. 2
FIG. 3
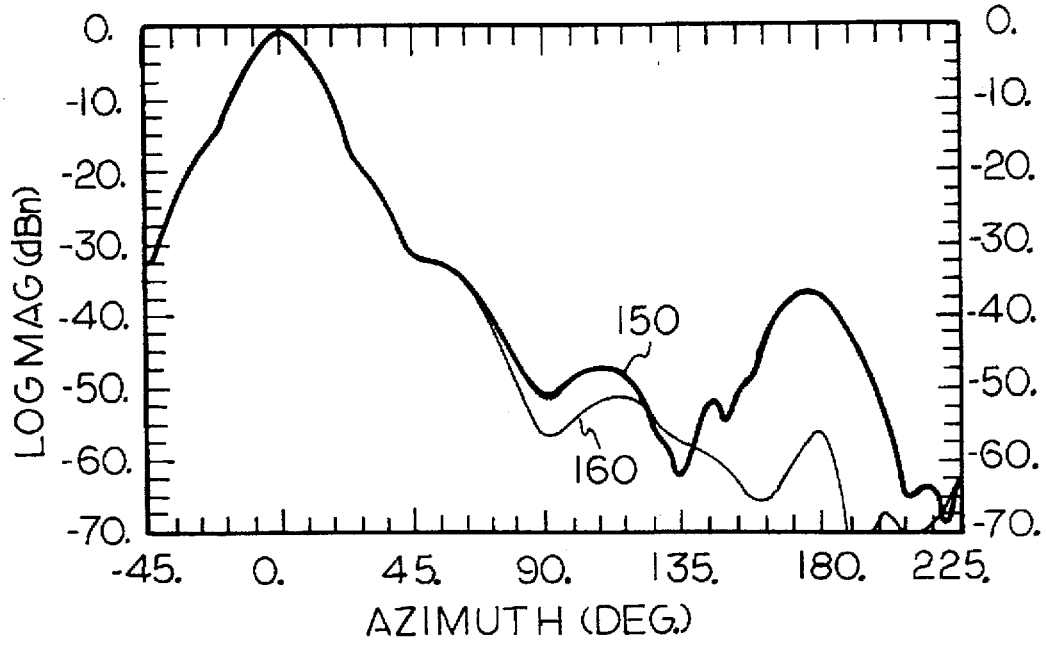

RADIO-FREQUENCY ABSORBING FIN BLANKET

CROSS REFERENCE TO RELATED APPLICATION

This application is a continuation-in-part of application Ser. No. 08/154,050, filed Nov. 18, 1993 now abandoned and entitled "Attenuation Fin Blanket For A Feed Horn." The entire disclosure of Ser. No. 08/154,050, now abandoned, is incorporated herein by reference.

FIELD OF THE INVENTION

This invention relates to fin blankets. In general, it relates to using a fin blanket to protect radio frequency ("RF") signals by absorbing and reducing radio frequency interference and scattering.

BACKGROUND OF THE INVENTION

An RF absorbing fin blanket may be used to attenuate RF scattering along most any suitable structure, including a feed horn, a deployable radiator panel of a satellite and the like. Horn antennas or feed horns have been widely used as a feed element for receiving and transmitting signals in large radioastronomy, satellite tracking and communications dishes, which primarily operate using microwave frequencies. In addition to its use as a feed for reflectors and lenses, the feed horn is a common element of phased arrays, and serves as a universal standard for calibration and gain measurement.

The total field radiated by the feed horn is a combination of a direct field and diffractions from edges of an aperture of the feed horn. Edge diffractions, particularly those at edges that are normal to an electric field, influence the radiation pattern of the antenna. The diffractions generate microwave energy in main (or on-axis) lobes, near lobes, far-out side lobes and back lobes. However, the microwave energy generated by the diffractions in the far-out side lobes and back lobes may have a greater and more undesirable effect. Additionally, reflections and diffractions associated with nearby satellite structures, such as deployable radiator panels, may cause detrimental scattering across a portion of the antenna pattern. In those instances, reducing far-out side lobes, back lobes and structural scattering, can significantly reduce the effects of radio frequency interference.

Optimum feed horns maximize the main (or on-axis) lobe and minimize far-out side and back lobes. Conventional methods of reducing the effects of diffraction include corrugations on the inside surface of the feed horn, curving the walls of the feed horn near the aperture, and connecting a C-shaped metal attachment to the outer surface of the feed horn.

However, such prior approaches to reduce the effects of diffraction add weight, which is undesirable in satellite applications. Furthermore, attenuation of the far-out side and back lobes has been insufficient to meet commercial needs for reduced radio frequency interference. In addition, feed horns typically require an aperture cover to provide thermal stability and to prevent contamination. However, fitting the aperture cover over the aperture of feed horns with curved walls has proven to be difficult.

Therefore, it is desirable to design a lightweight feed horn producing radiation patterns with highly attenuated far-out side and back lobes without significant weight increase. It is also desirable to design an improved lightweight RF absorbing fin blanket for protection of an antenna or a portion of a spacecraft against RF scattering effects generated from sources of radiation.

SUMMARY OF THE INVENTION

Briefly, the invention relates to a fin blanket for attenuating radio-frequency scattering, thereby protecting an associated surface, such as a radio-horn or radiator panels of a spacecraft. The fin blanket includes a plurality of fins formed of a microwave absorbing film, each fin including a first planar side and a second planar side positioned generally parallel to an electric field formed by the radio-frequency scattering. The blanket includes a sufficient quantity of fins to cover the surface width and length to protect the surface from radio-frequency scattering. In a preferred embodiment, each fin has a crest spaced a distance "D" from one another, which is less than one-half of an operating wavelength at the highest frequency, a minimum height "H" of one-half the operating wavelength at the lowest frequency, and a length "L" of one operating wavelength at the lowest frequency.

In addition, the present invention relates to a method of attenuating radio-frequency scattering impinging upon the surface. The method includes the steps of providing a plurality of fins formed of a microwave absorbing film, each fin including first and second planar sides; and orienting each fin upon the surface wherein the planar sides are generally parallel to an electric field formed by the radio-frequency scattering.

It is a feature of the invention, that the attenuation means is composed at least partially of plural layers of polyimide film such as KAPTON® film for reducing radio-frequency signals (RF) along a surface requiring surface wave or field attenuation.

In yet another feature of the invention, the attenuation device is made at least partially of KAPTON® with pigment, such as carbon powder to provide a black polyimide membrane material referred to as Carbon Filled KAPTON (CFK). Black polyimide is a preferred film material in that it absorbs microwave energy impinging upon the surface to be protected. By absorbing the microwave energy, the radio-frequency interference (RFI) is greatly reduced.

In still another feature of the invention, the height, crest length, and spacing between the fin crest may be adjusted to achieve a desired bandwidth. The RF match may be adjusted by the height of the fin and/or the resistivity of the carbon KAPTON material.

Other object, features and advantages will be readily apparent.

BRIEF DESCRIPTION OF THE DRAWINGS

The various advantages of the present invention will become apparent to those skilled in the art after studying the following specification and by reference to the drawings in which:

FIG. 2 illustrates elevation side lobe reduction of the feed horn incorporating the attenuation fin blanket;

FIG. 3 illustrates azimuth side lobe reduction of the feed horn incorporating the attenuation fin blanket;

DESCRIPTION OF THE PREFERRED AND ALTERNATE EMBODIMENTS

For purposes of simplicity and clarity, an RF absorbing fin blanket 130 in accordance with the present invention is described herein in detail in connection with a feed horn. Though the invention has been described with reference to a feed horn for absorbing RF scattering, it will be appreciated that the invention may be employed on most any suitable application requiring surface wave or field attenuation as well known in the art. For example, because the fins 134 in accordance with the present invention are thin, lightweight, thermally stable and easy to assemble, they may be used on a wide variety of surfaces including spacecraft surfaces such as the exterior surfaces of deployable satellite radiator panels.

As well known, antennas convert electrical energy to electromagnetic waves that radiate away from the antenna at speeds near the speed of light, and also convert electromagnetic waves back to electrical energy. Radiation of electromagnetic energy is based on the principle that a moving electric field creates a magnetic field and a moving magnetic field creates an electric field. The electric (E) and magnetic (H) fields together form electromagnetic radiation and are perpendicular to each other and their direction of motion. Antennas normally radiate in all directions. Feed horns are used to direct transmitted electromagnetic radiation and to receive electromagnetic radiation from a particular direction.

An RF absorbing fin blanket may be used to attenuate RF scattering impinging upon an antenna or most any suitable structure, including a deployable radiator panel of a satellite or the like. The fin blanket includes a plurality of fins formed of a microwave absorbing film, each fin including a first planar side and a second planar side positioned generally parallel to an electric field formed by the radio-frequency scattering. In a preferred embodiment, each fin has a crest spaced a distance "D" from one another, which is less than one-half of an operating wavelength at the highest frequency, a minimum height "H" of one-half the operating wavelength at the lowest frequency, and a length "L" of one operating wavelength, at the lowest frequency. The RF match may be adjusted by the height of the fin and/or the resistivity of the film material.

Figure 1A:
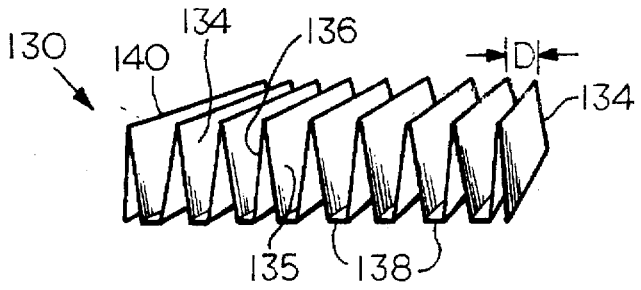
FIG. 1A is a perspective view of an attenuation fin blanket according to the present invention.
Figure 1B:
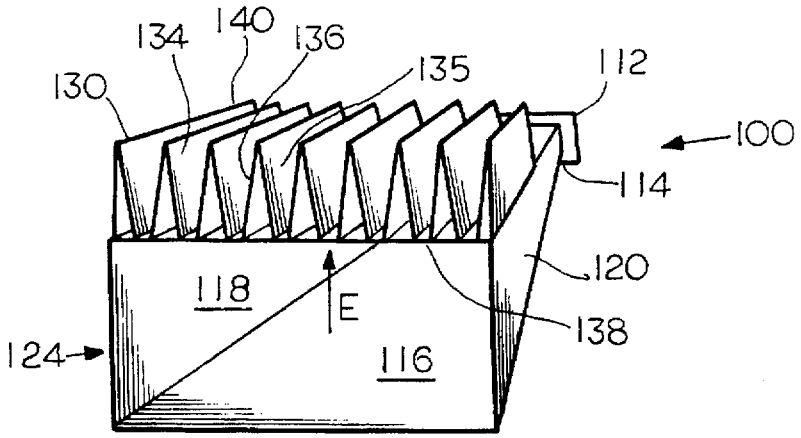
FIG. 1B is a perspective view of the attenuation fin blanket attached to a pyramidal feed horn.
Figure 1C:
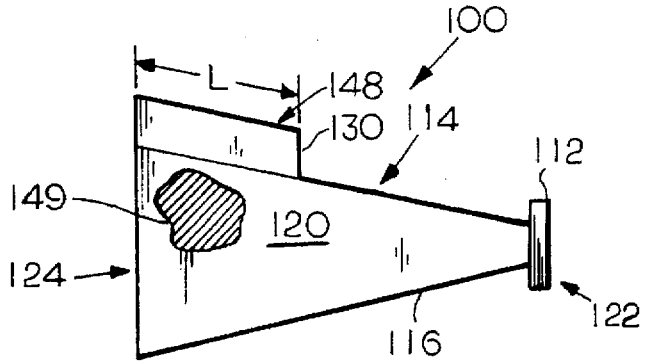
FIG. 1C is a side view of the attenuation fin blanket and feed horn of FIG. 1B.

Referring to FIGS. 1A, 1B and 1C, a feed horn 100 embodying the present invention is shown including a base 112, top and bottom sides 114 and 116, and left and right sides 118 and 120. The top, bottom, left and right sides 114, 116, 118 and 120 can be flared as with a pyramidal feed horn. The top and bottom flaring sides 114 and 116 and the left and right flaring sides 118 and 120 can define a pyramid-shape with a small aperture 122 adjacent the base 112 and a large aperture 124 at an opposite end.

The designations of top, bottom, left and right are made when looking through the large aperture 124 towards the small aperture 122. The feed horn 100 is positioned such that an E field (identified by arrow "E" in FIG. 1B) propagates in a plane substantially (due to flaring) parallel to the left and right flaring sides 118 and 120, and such that the H field propagates in a plane substantially parallel to the top and bottom flaring sides 118 and 120.

An attenuation fin blanket 130 includes a plurality of fins 134 each including first and second planar sides 135 and 136. The fins 134 can be formed from separate films (FIGS. 4, 5 and 7) or can be formed from a single film folded as a string or series of fins (FIGS. 1A and 6) as more fully described below.

Figure 6:
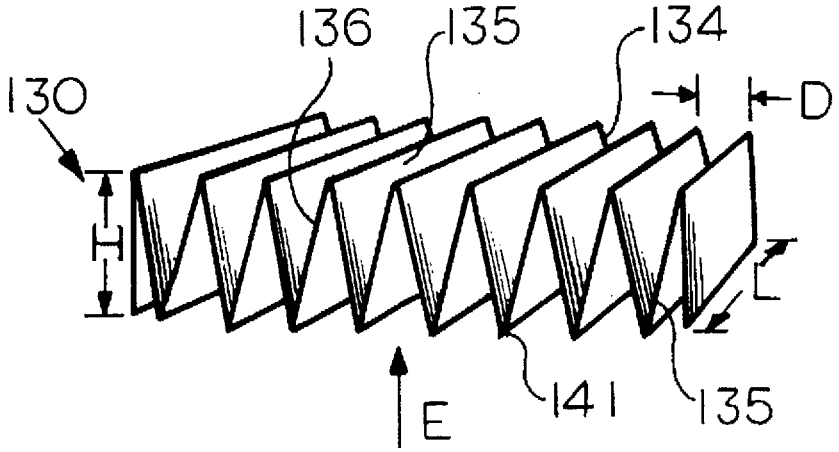
FIGS. 6 and 7 are perspective views of various alternate fin blankets according to the present invention.
Figure 7:
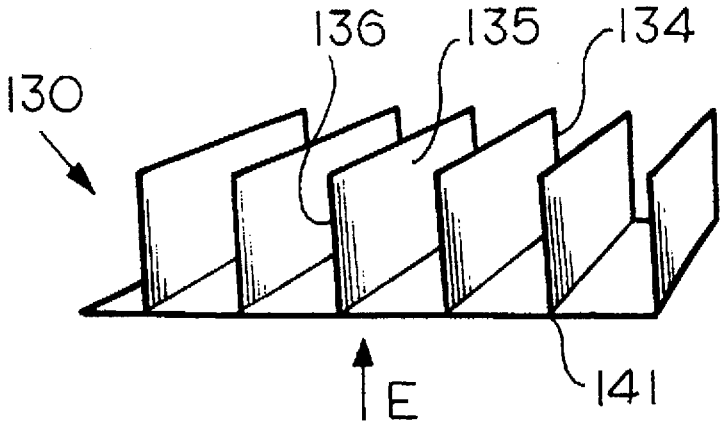

As shown in FIG. 1A, the first side 135 of one fin 134 may be connected to the second side 136 of an adjacent fin 134 by a surface 138, such as a triangular surface, rectangular surface, square surface or the like, which provides uniform spacing for the fins along a panel. In an alternate embodiment, the first side 135 of one fin and second side 136 of an adjacent fin are joined at an upper crest 140 and at a lower crest 141 with the side 136 of the next adjacent fin (FIG. 6). The sides 135 or 136 of adjacent fins 134 may also be spaced apart parallel to one another and connected at a surface 138 to form a blanket of fins (FIG. 7).

In its simplest form, the blanket 130 includes a series of fins 134 of a sufficient number to cover the width of the panel surface and of sufficient length to extend the length of the panel surface. The fins 134 have a crest 140 preferably spaced a distance "D" which is less than one-half of an operating wavelength at the highest frequency (corresponding to design frequency). In addition, the fins have a minimum height "H" of one-half the operating wavelength at the lowest frequency, along with a length "L" of one operating wavelength.

The attenuation fin blanket 130 can be attached to an outer side of the top surface 114 which is perpendicular to the E field designated by the arrow "E" by any suitable means, for example fasteners, adhesive, etc. When viewed as in FIG. 1C, the fins have a parallelogram cross-section.

A top ridge 148 (FIG. 1C) defined by the crests 140 of the fins 134 should be substantially parallel to the top surface 114. Preferably, two attenuation fin blankets 130 and 130' (not shown) are attached to one feed horn 100. One attenuation fin blanket 130 is attached as shown in FIG. 1C, and another attenuation fin blanket 130 can be attached to an outer surface of the flaring bottom side 116 in an analogous manner. As can be appreciated, the attenuation fin blanket 130 is attached to the bottom side 116 which is also normal to the E field indicated by the arrow "E".

The attenuation fin blanket 130 should be made of a material which absorbs microwave energy. For example, the attenuation fin blanket can be made of a microwave absorbing film, such as polyimide resin film which provides both thermal insulation and resistance. Preferably, the polyimide resin film is impregnated with carbon particles. Polyimide resin film and carbon-impregnated polyimide resin film are available from DuPont, Inc. under the trademark KAPTON®. The only thickness requirement of the fin 134 is that of the carbon KAPTON membrane used to form the fins. The about thickness of Carbon Filled KAPTON is between 0.0005–0.003 inches thick. Thicker coatings will not exhibit higher RF absorption; however, it will be appreciated that there is a trade-off of RF absorption for reduced physical fin height and fin coating density.

Another microwave-absorbing material suitable for the attenuation fin blanket 130 is fiberglass covered with a metallic film. The metallic film can be nickel, chrome, or an alloy of nickel and chrome. Preferably, the fiberglass is 20–30 mm. thick. Other suitable materials for the attenuation fin blanket will be readily apparent.

The material used for the attenuation fin blanket 130 should have a resistance less than 1,000 Ω/square. A resistance of approximately 377 Ω/square is preferable.

Portions of the outer surfaces of the left, right, top and bottom sides 114, 116, 118 and 120 can be covered with a thin cover 149 having a much higher or lower resistance than the material used for the attenuation fin blanket 130 for thermal insulation purposes. Metallized film or vacuum deposited aluminum (VDA) layers can also be used. Alternately, the thin cover 149 can be adhered to the outer surfaces not covered by the attenuation fin blanket. The thin cover 149 should have a resistance on the order of $10^8$ Ω/square or lower. FIG. 2 illustrates elevation side lobe reduction and FIG. 3 illustrates azimuth side lobe reduction of the feed horn 100 of the present invention. A radiation pattern 150 was generated by a conventional feed horn without the attenuation fin blanket 130 of the present invention and a radiation pattern 160 was generated by the feed horn 100 with the attenuation fin blanket 130 affixed to the flaring top and bottom sides 114 and 116 according to the invention. A first length of the flaring top and bottom sides 114 and 116 at the large aperture 154 is 9.0", and a second length of the flaring left and right sides 118 and 120 at the large aperture is 8.7". The feed horn 100 was operated at 3.95 GHz.

Table A summarized the results:

TABLE A

| Angle from Boresight | Azimuth Side lobe Reduction | Elevation Side lobe Reduction |
|---|---|---|
| 90 | >5.0 dB | >2.0 dB |
| 135 | >5.0 dB | >6.0 dB |
| 180 | >20.0 dB | >18.0 dB |

Similar attenuation was obtained at 3.7 GHz and 4.25 GHz. As can be appreciated, the attenuation fin blanket 130 also provides significant back lobe reduction.

Figure 4:
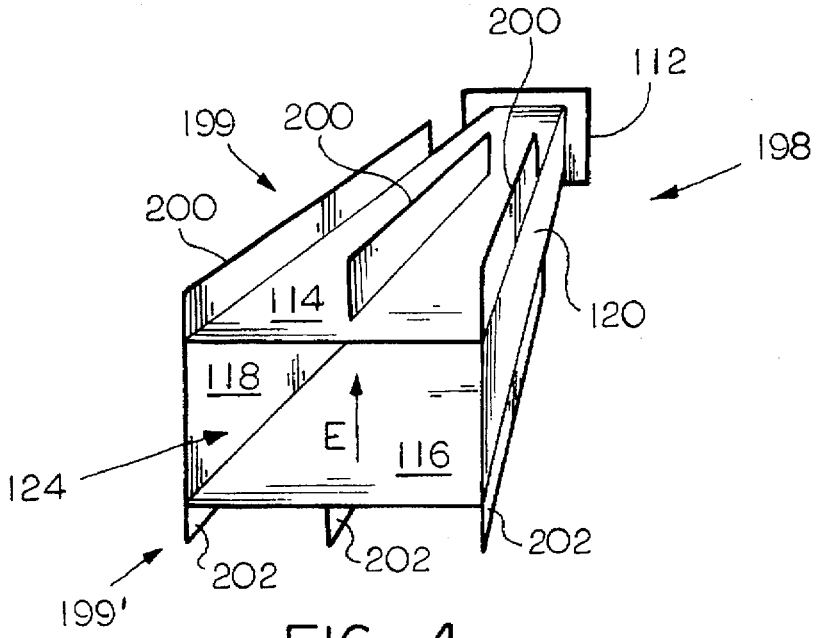
FIG. 4 is a perspective view of an alternate feed horn including vertical fins.

In FIG. 4, an alternate feed horn 198 includes an attenuation device 199 with a plurality of vertical fins 200 attached to the top side 114 and an attenuation device 199' with a plurality of fins 202 attached to the bottom side 116 normal to the E-field. For clarity purposes, reference numbers from FIG. 3 will be used where appropriate. The vertical fins can be individually supported or can be formed integrally with a blanket. The vertical fins 200 and 202 have a height greater than or equal to one half wavelength and are spaced less than or equal to one half wavelength. As can be appreciated, the vertical fins 200 and 202 absorb microwave energy behind and to the sides of the feed horn 198 to reduce radio frequency interference.

Figure 5:
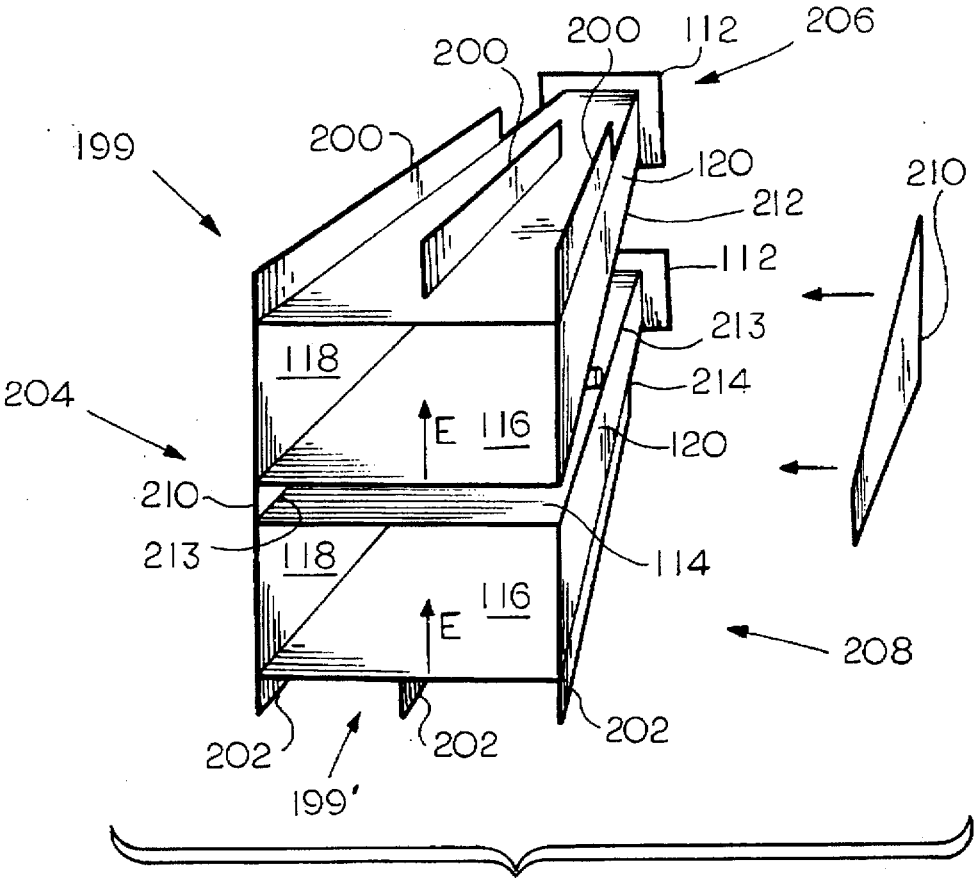
FIG. 5 is a perspective view of a feed horn array including vertical fins.

In FIG. 5, a feed horn array 204 includes first and second feed horns 206 and 208 stacked in a direction parallel to the E-field. For clarity purposes, reference numbers from FIGS. 3 and 4 will be used where appropriate. The vertical fins 200 are attached to the top surface 114 of the first feed horn 206. The vertical fins 202 are attached to the bottom surface 116 of the second feed horn 208. Trapezoid-shaped sections 10 of microwave absorbing material are connected between corners 212 formed by the bottom side 116 and the left and right sides 118 and 120 of the first feed horn 206 and corners 213 formed by the top side 114 and the left and right sides 118 and 120 of the second feed horn. A roll 214 of microwave absorbing material is located between the bottom side 116 of the first feed horn 206 and the top side 114 of the second feed horn 208.

As can be appreciated, the vertical fins 200 and 202, the trapezoid-shaped sections 210, and the roll 214 can be made with microwave absorbing materials described above with respect to attenuation fin blanket 130. Each vertical fin 200 and 202 preferably has a resistance between 160–330 Ω/square. The RF absorbing fins are broadbanded having a range between 10 Ω/square to 10,000 Ω/square with the most useful range between 100–1000 Ω/square.

While the fins have been described above in conjunction with a pyramidal horn antenna used at microwave frequencies for purposes of illustration, it will be appreciated that one skilled in the art can readily adapt the fins for other uses once the invention is disclosed and explained and at other frequencies by scaling the length (L) and height (H) of the fins and the distance (D) between the crests of the fins. As can be appreciated, while a feed horn array 204 is shown with vertical fins, individually supported triangular fins or the attenuation fin blanket may also be used in other applications. For example, because of the configuration and the material forming the fins 134, it has been found that the fins may find particular application on a spacecraft, e.g. a satellite, for absorbing RF scattering. When an antenna is mounted on a satellite, RF signals along the surface of the satellite may cause RF scattering problems across a portion of the antenna pattern. An absorption fin blanket 130 in accordance with the present invention may be used to significantly attenuate RF signals across components of the satellite.

An RF absorbing fin blanket 130 according to the present invention was tested by exposure to a simulated satellite environment. The test included placing a metallic plate in the field of a KU-band horn in such a manner as to effect its cross-polarization performance. A single layer class IV carbon KAPTON film blanket shaped into fins approximately 0.3 inches in height and approximately 0.75 inches apart was placed over the metallic plate. The absorption fin panel achieved an approximate −10 db return loss to normal radiation in the frequency range of 3–18 GHz and little or no degregation of the cross-pol patterns. It is believed that the foregoing test is equivalent to applying absorption fin blankets along satellite components, such as deployable radiators or the like, which may cause RF scattering problems to the nearby antenna.

The various advantages of the present invention will become apparent to those skilled in the art after a study of the foregoing specification and following claims.

What is claimed is:

1. A fin blanket comprising:

a plurality of planar, substantially two-dimensional fins comprising a microwave absorbing film, each fin including at least one side substantially parallel to an electric field formed by radio-frequency scattering.

2. The fin blanket of claim 1 wherein each fin blanket includes a plurality of fins to cover a surface to protect the surface from radio-frequency scattering.

3. The fin blanket of claim 1 wherein said fins have a crest spaced a distance "D" which comprises less than one-half of an operating wavelength at a highest frequency and a minimum height "H" of one-half the operating wavelength at a lowest frequency and a minimum length "L" of one operating wavelength at the lowest frequency, wherein said highest frequency does not equal said lowest frequency.

4. The fin blanket of claim 1 wherein said microwave absorbing film forming each fin comprises between 10 Ω/square and 10,000 Ω/square.

5. The fin blanket of claim 1 wherein said microwave absorbing film forming each fin comprises between 100 Ω/square and 1,000 Ω/square.

6. The fin blanket of claim 2 wherein said microwave absorbing film is selected from the group consisting of polyimide resin films and polyimide resin films impregnated with carbon particles.

7. The fin blanket of claim 1 wherein said microwave absorbing film is selected from the group consisting of polyimide resin film and wherein said film includes at least one of nickel, nichrome or vacuum deposited aluminum.

8. The fin blanket of claim 6 wherein said microwave absorbing film thickness comprises about 0.0005–0.003 inches thick.

9. The fin blanket of claim 2 wherein the surface comprises an exterior surface of a spacecraft structure.

10. The fin blanket of claim 8 wherein said exterior surface comprises a radiator panel of a satellite.

11. A fin blanket for attenuating radio-frequency scattering upon an exterior surface of a radiator panel of a satellite, said fin blanket including a plurality of fins to cover the surface to protect the surface from radio-frequency scattering and having a crest spaced a distance "D" which comprises less than one-half of an operating wavelength at a highest frequency and a minimum height "H" of one-half the operating wavelength at a lowest frequency and a length "L" of one operating wavelength at the lowest frequency, wherein said highest frequency does not equal said lowest frequency.

12. The fin blanket of claim 11 wherein said fins comprise a microwave absorbing film between 10 Ω/square and 10,000 Ω/square.

13. The fin blanket of claim 11 wherein said fins each comprise a substantially planar and two-dimensional structure having a first planar side and a second planar side positioned generally parallel to an electric filed formed by the radio-frequency scattering.

14. The fin blanket of claim 12 wherein said microwave absorbing film is selected from the group consisting of polyimide resin films and polyimide resin films impregnated with carbon particles.

15. The fin blanket of claim 12 wherein said microwave absorbing film is selected from the group consisting of polyimide resin film and wherein said film includes at least one of nickel, nichrome or vacuum deposited aluminum.

16. The fin blanket of claim 12 wherein said microwave absorbing film thickness comprises about 0.0005–0.003 inches thick.

17. A method of attenuating radio-frequency scattering impinging upon a surface to be protected, the method including the steps of:

providing a plurality of substantially planar and two-dimensional fins, each fin comprising a microwave absorbing film and at least one planar side; and orienting each fin upon the surface wherein the planar sides are generally parallel to an electric field formed by the radio-frequency scattering.

18. The method of claim 17 wherein the fins each have a crest spaced a distance "D" which comprises less than one-half of an operating wavelength at a highest frequency and a minimum height "H" of one-half the operating wavelength at a lowest frequency and a length "L" of one operating wavelength at the lowest frequency, wherein said highest frequency does not equal said lowest frequency.

19. The method of claim 17 wherein the microwave absorbing film is selected from the group consisting of polyimide resin films and polyimide resin films impregnated with carbon particles.

20. The method of claim 17 wherein the microwave absorbing film is selected from the group consisting of polyimide resin film and wherein said film includes at least one of nickel, nichrome or vacuum deposited aluminum.

* * * * *